US011012784B2

(12) United States Patent
Heilemann et al.

(10) Patent No.: US 11,012,784 B2
(45) Date of Patent: May 18, 2021

(54) METHOD AND DEVICE FOR FORCE CONCENTRATION TO ENHANCE SOUND FROM FLAT PANEL LOUDSPEAKERS

(71) Applicant: The University of Rochester, Rochester, NY (US)

(72) Inventors: Michael Charles Heilemann, Rochester, NY (US); Mark Frederick Bocko, Caledonia, NY (US)

(73) Assignee: THE UNIVERSITY OF ROCHESTER, Rochester, NY (US)

( * ) Notice: Subject to any disclaimer, the term of this patent is extended or adjusted under 35 U.S.C. 154(b) by 0 days.

(21) Appl. No.: 16/592,333

(22) Filed: Oct. 3, 2019

(65) Prior Publication Data

US 2020/0120426 A1 Apr. 16, 2020

Related U.S. Application Data

(60) Provisional application No. 62/745,324, filed on Oct. 13, 2018.

(51) Int. Cl.

| | |
|---|---|
| ***H04R 9/06*** | (2006.01) |
| ***H04R 9/02*** | (2006.01) |
| ***H04R 1/28*** | (2006.01) |
| ***H04R 7/04*** | (2006.01) |

(52) U.S. Cl.

CPC ..... *H04R 9/06* (2013.01); *H04R 1/2803* (2013.01); *H04R 7/045* (2013.01); *H04R 9/025* (2013.01)

(58) Field of Classification Search

CPC ..... H04R 9/06; H04R 1/2803; H04R 7/045; H04R 9/025

USPC ..... 381/400

See application file for complete search history.

(56) References Cited

U.S. PATENT DOCUMENTS

| | | | | |
|---|---|---|---|---|
| 2006/0165246 | A1* | 7/2006 | Lee | H04R 9/066 381/151 |
| 2006/0262954 | A1* | 11/2006 | Lee | H04M 1/03 381/380 |
| 2019/0111840 | A1* | 4/2019 | Kang | H04R 9/066 |
| 2019/0261092 | A1* | 8/2019 | Landick | H04R 7/045 |

* cited by examiner

*Primary Examiner* — Sean H Nguyen

(74) *Attorney, Agent, or Firm* — Ping Wang; Morris, Manning & Martin LLP

(57) ABSTRACT

A mechanical coupling device and methods of use for concentrating dynamic force transmitted from a dynamic force actuator to a panel. The device comprises a concentrator surface that is coupled to an elastic panel. The concentrator surface is a continuous region with a surface area that may be smaller, larger, or the same surface area as a region in contact with a dynamic force actuator. The concentrator surface transmits a dynamic force to a region of the panel coupled to the concentrator surface.

20 Claims, 8 Drawing Sheets

METHOD AND DEVICE FOR FORCE CONCENTRATION TO ENHANCE SOUND FROM FLAT PANEL LOUDSPEAKERS

This application claims priority to U.S. Provisional Application Ser. No. 62/745,324, filed Oct. 13, 2018. The entirety of the aforementioned applications is incorporated herein by reference.

FIELD

The application relates to the field of vibrational acoustics and specifically to the design of flat panel loudspeakers.

BACKGROUND

Typical electrodynamic force actuators are designed with a cylindrical voice coil, the top surface of which has an adhesive material applied to it so it may be bonded to the object to which the vibrational force is to be applied. The contact area between the force exciter and the panel is annular in typical applications. A problem with this configuration is that at high frequencies the area of the panel within the force actuator's annular contact area may vibrate out of phase with the panel area exterior to the exciter's annular contact area. This occurs at the resonant frequency of the first "drum head" mode of the panel area interior to the annular contact region. Under these conditions, and due to the phase reversal between the vibrating region within the annular contact area and the panel area exterior to the contact annulus, the net acceleration of the panel integrated over the entire panel area decreases noticeably. The total radiated sound pressure is proportional to the net acceleration integrated across the entire panel so there is a noticeable dip in the sound pressure at the frequency where this occurs. Often this can be in the region around 10 kHz, which leads to a noticeable deficit of high frequency content in the radiated sound.

There is a need for a device that will enable dynamic force actuators to perform without noticeable dips in sound pressure occurring at certain frequencies.

SUMMARY

An aspect of the application is a mechanical coupling device for concentrating dynamic force transmitted from a dynamic force actuator to a panel, the device comprising: a base surface, wherein the base surface is a surface that is coupled to an active surface of a dynamic force actuator; a plateau on a reverse side of the device to the base surface, wherein the plateau has a top and sides, and wherein the top of the plateau is a concentrator surface that is coupled to a panel, and the sides of the plateau are a transition connecting the concentrator surface to an outer edge of the device on the reverse side of the device to the base surface; and wherein the concentrator surface is a continuous region with a surface area that may be smaller, larger, or the same surface area as a region of the base surface in contact with the dynamic force actuator, and wherein the concentrator surface transmits a dynamic force to a region of the panel coupled to the concentrator surface.

There are a variety of embodiments which may be embodied separately or together in combination in the aspects of the application; an independent listing of an embodiment herein below does not negate the combination of any particular embodiment with the other embodiments listed herein.

In certain embodiments, the device comprises aluminum alloy, titanium, beryllium or other metals with a high speed of sound transmission to ensure that all mechanical resonances of the device lie above the range of audible frequencies, wherein the mechanical resonances include longitudinal, bending, shear and torsional waves. In certain embodiments, the device comprises composite materials including one or more selected from the group consisting of fiberglass, carbon fiber, and other composites with a high speed of sound transmission to insure that all mechanical resonances of the element lie above the range of audible frequencies. In certain embodiments, the device comprises synthetic materials including one or more selected from the group consisting of acrylic, polyvinylchloride, and other synthetic materials with a high speed of sound transmission to insure that all mechanical resonances of the element lie above the range of audible frequencies.

In certain embodiments, one or more vent holes are formed into the device to allow trapped air within the dynamic force actuator to escape. In certain embodiments, the base surface is circular with a larger diameter than the concentrator surface. In certain embodiments, the transition is step-wise connecting the boundary to the concentrator surface by a step surface at 90 degrees to the boundary. In certain embodiments, the transition is a concave surface connecting the boundary to the concentrator surface. In certain embodiments, the transition is a tapered surface connecting the boundary to the concentrator surface. In certain embodiments, the concentrator surface is circular. In certain embodiments, the concentrator surface is square. In certain embodiments, concentrator surface is rectangular. In certain embodiments, the base surface and plateau of the device form together a polygonal shape. In certain embodiments, the base surface and plateau of the device form together an ellipsoidal shape. In certain embodiments, the base surface and plateau of the device form together a shape in which a surface having a greater surface area is coupled to the dynamic force actuator and a surface with a lesser surface area is coupled to the panel.

Another aspect of the application is a method of generating sound using the mechanical device as described herein, comprising the steps of: interposing the device as described herein between an active surface of a dynamic force actuator and a panel; generating a dynamic force with the dynamic force actuator; transmitting the dynamic force through the device as described herein via the concentrator surface to the panel; generating sound from the panel through the action of the dynamic force transmitted by the device as described herein.

In certain embodiments, the panel is a component of a flat panel loudspeaker. In certain embodiments, the dynamic force actuator is a voice coil.

Another aspect of the application is a method of concentrating a dynamic force generated by a dynamic force actuator onto a flat panel, comprising the steps of: adhering the base surface of the device as described herein to an active surface of a dynamic force actuator; adhering the concentrator surface of the device as described herein to a panel; generating a dynamic force with the dynamic force actuator; transmitting the dynamic force through the device as described herein via the concentrator surface to the panel.

In certain embodiments, the adhering is performed by use of a glue.

BRIEF DESCRIPTION OF THE DRAWINGS

FIG. 4(*b*) shows a side-view of the resonant condition in which a force actuator is not equipped with a force concentrator device; FIG. 4(*c*) shows a side-view of the resonant condition in which a force actuator is equipped with a force concentrator device;

FIG. 5(*b*) shows a design of a force concentrator in which the transition is a linear ramp; FIG. 5(*c*) shows a design of a force concentrator in which the transition is a tapered curve;

FIG. 6(*b*) shows a top view of a force concentrator with vent holes;

FIG. 7(*b*) shows force concentrators in various sizes and thicknesses made of aluminum.

Figure 1:
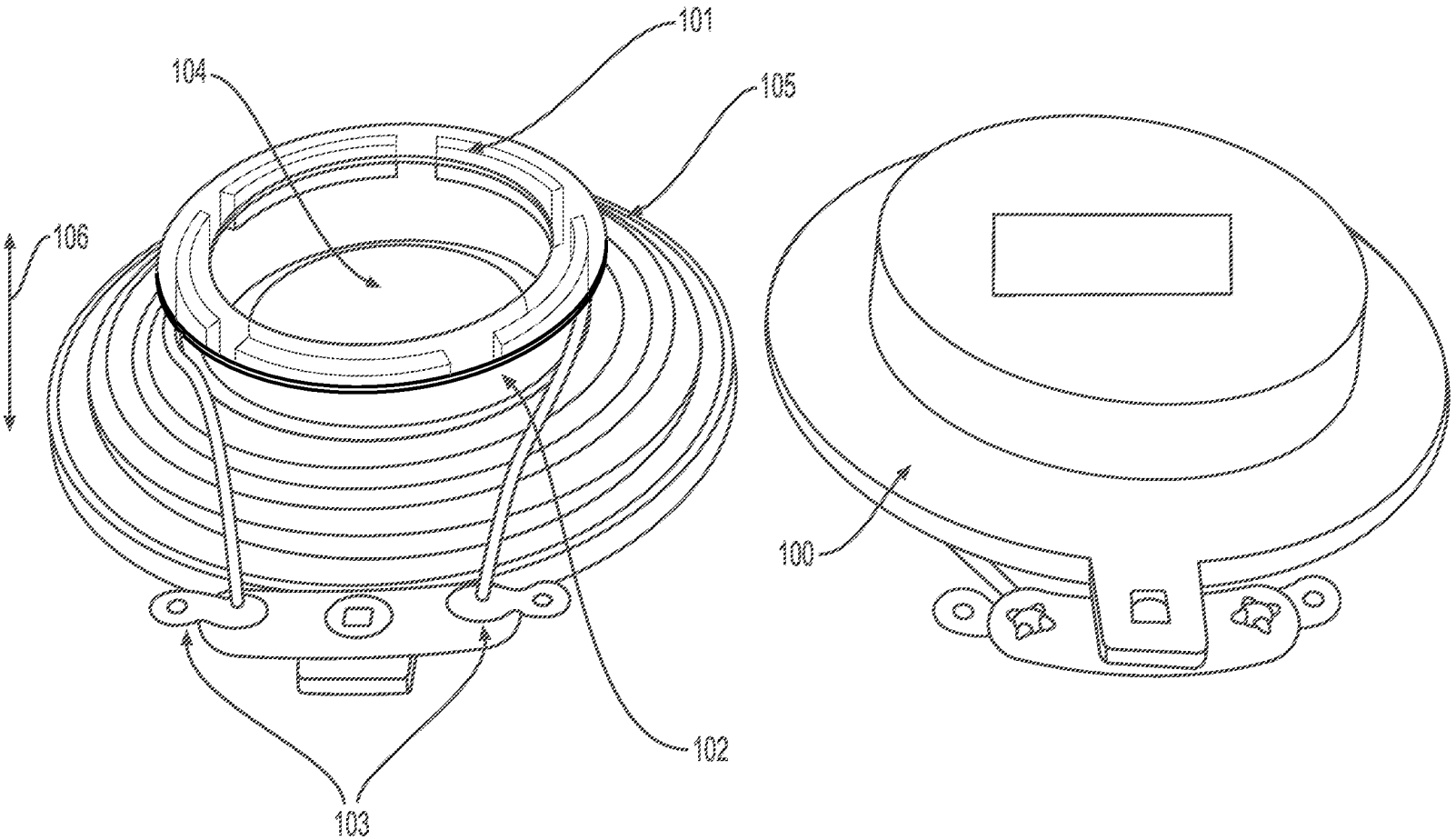
FIG. 1 (PRIOR ART)
FIG. 1 shows a typical electrodynamic vibration exciter.

While the present disclosure will now be described in detail, and it is done so in connection with the illustrative embodiments, it is not limited by the particular embodiments illustrated in the figures and the appended claims.

DETAILED DESCRIPTION OF THE INVENTION

Reference will be made in detail to certain aspects and exemplary embodiments of the application, illustrating examples in the accompanying structures and figures. The aspects of the application will be described in conjunction with the exemplary embodiments, including methods, materials and examples, such description is non-limiting and the scope of the application is intended to encompass all equivalents, alternatives, and modifications, either generally known, or incorporated here. Unless otherwise defined, all technical and scientific terms used herein have the same meaning as commonly understood by one of ordinary skill in the art to which this application belongs. One of skill in the art will recognize many techniques and materials similar or equivalent to those described here, which could be used in the practice of the aspects and embodiments of the present application. The described aspects and embodiments of the application are not limited to the methods and materials described.

As used in this specification and the appended claims, the singular forms "a," "an" and "the" include plural referents unless the content clearly dictates otherwise.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself.

Voice Coil Actuators

Voice coil actuators are direct drive, limited motion devices that utilize a permanent magnet field and coil winding (conductor) to produce a force that is proportional to the current applied to the coil. The electromechanical conversion mechanism of a voice coil actuator is governed by the Lorentz Force Principle. This law of physics states that if a current-carrying conductor is placed in a magnetic field, a force, "F", will act upon it. The magnitude of this force is determined by the magnetic flux destiny, "B", the current, "I", and the orientation of the field and the current vectors. Furthermore, if a total of "N" conductors (in series) of length "L" are placed in the magnetic field, the force acting upon those conductors is shown by Equation (1):

$$F=kBLIN, \quad \text{(Equation 1)}$$

where k equals a constant.

the direction of the force generated is a function of the direction of current and magnetic field vectors. Specifically, it is the cross-product of the two vectors. If current flow is reversed, the direction of the force on the conductor will also reverse. If the magnetic field and the conductor length are constant, as they are in a voice coil actuator, then the generated force is directly proportional to the input current.

Furthermore, a conductor moving through a magnetic field will have a voltage induced across the conductor. The magnitude of the voltage, E, is dependent on the magnetic flux density, B, the length of the conductor, L, and the speed of the conductor traverses the field. The voltage potential induced in the conductor (i.e., the back EMF) is shown by Equation (2):

$$E=kBLvN, \quad \text{(Equation 2)}$$

Where k equals a constant and N equals the total number of conductors of length L.

Equations (1) and (2) can be restated as follows: a device that contains a permanent magnet field and coil winding moving in the field will produce a force proportional to current [carried in the coil] and a voltage proportional to velocity [of the coil].

FIG. 1 shows a picture of a prior art electrodynamic vibration exciter (a voice coil actuator), which can function as a dynamic force actuator on an elastic panel. The voice coil actuator is a single phase device. Application of a voltage across the two coil leads will generate a current in the coil, causing the coil to move axially along the air gap. The direction of movement is determined by the direction of a current flow in the wire. The case (100) contains a voice coil form (101) supporting voice coil windings (102) that are connected to terminals (103) through which electric current is supplied. A magnet (104) surrounds the voice coil form and voice coil windings, which are connected to the case by a suspension (105), and exerts magnetic force in force direction (106).

In FIG. 1, the operation of the device is similar to that of a conventional electrodynamic loudspeaker in which an electrical current is passed through a coil of wire wound onto a voice coil form. The voice coil assembly is held in place by a suspension that is compliant in one direction. The coils of wire of the voice coil are held in a region of space containing a magnetic field. The magnetic field is perpendicular to the direction of the voice coil windings so the passage of an electrical current through the wire gives rise to a force that is perpendicular to both the winding direction and the magnetic field. The resulting force direction (106) is indicated in FIG. 1, and in this case is in a direction along the symmetry axis of the force actuator.

A Force Concentrator

A concentrated force is considered to act along a single line in space, but represents a mathematical idealization. In practice, surface forces act over an area. Surface force may be denoted as $f_s$ the force that acts across an internal or external surface element in a material body. Surface forces can be decomposed into normal forces, which act normally over an area (e.g. pushing or pulling forces that act perpendicularly to the surface), and shear forces which act tangentially over an area (e.g., frictional forces as a block moves on a surface). Surface force may be calculated as follows:

$f_s$=pA, where f=force, p=pressure, and A=area on which a uniform pressure acts (and pressure p equals force f/area A).

The force concentrator device disclosed herein is designed to apply in effect a distributed load across the contact area between the surface of an elastic panel to which the force concentrator has been adhered. The distributed load is a concentrated surface contact force. The contact force originates with the action of the dynamic force actuator (e.g., the magnetic force generated by a voice coil) to which the force concentrator is also adhered. The force concentrator provides the distributed load in a spatially limited manner so that sound distorting out-of-phase vibrations of the panel are avoided.

Figure 2:
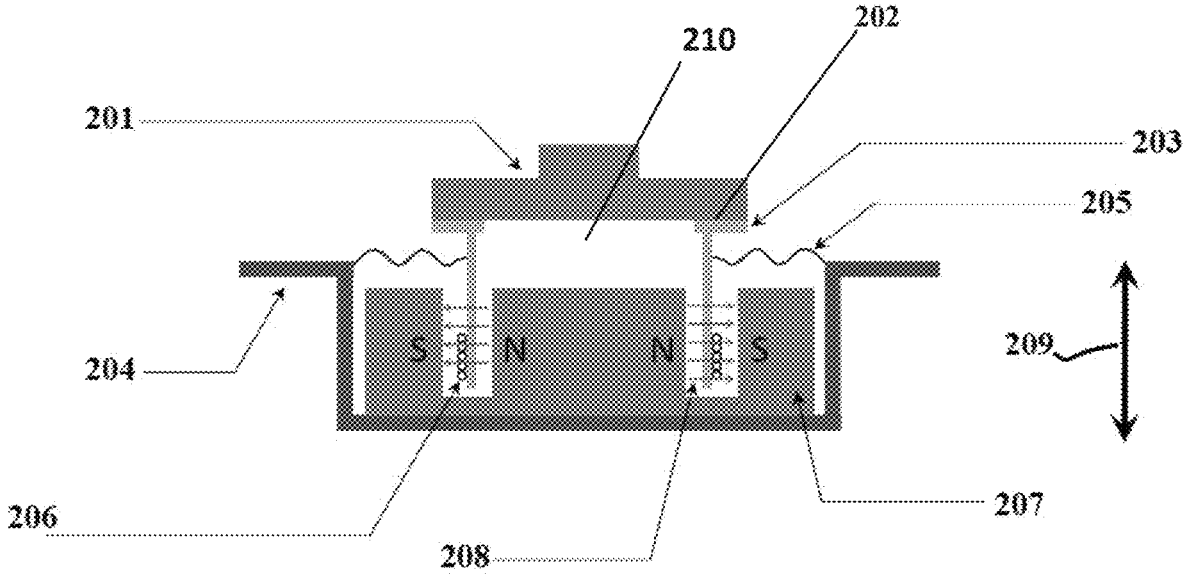
FIG. 2 shows a cross sectional drawing of an electrodynamic force actuator with a force concentrator in position.

FIG. 2 shows a cross sectional drawing of a dynamic force actuator, with its various parts labeled, with a particular embodiment of a force concentrator (201) mounted on the voice coil interface surface (202) on the voice coil form (203). As can be seen, the voice coil form is connected to the case (204) by the suspension (205) while the voice coil windings (206) are surrounded by the magnet (207) and subject for the magnetic field lines (208). When the current is switched on, this results in a force direction (209) which moves the force concentrator in relation to the air gap (210) used to couple the actuator to the surface of the panel serving a loudspeaker.

Action of a Force Concentrator

The present application particularly discloses a force concentrator device that is interposed between the annular contact region of a force actuator that is a voice coil and an elastic panel to concentrate the force from the actuator to a small circular region on the panel. This avoids the out-of-phase vibration of the panel region interior to the annular contact area thereby eliminating the dip in the frequency response at the resonant frequency.

Figure 3:
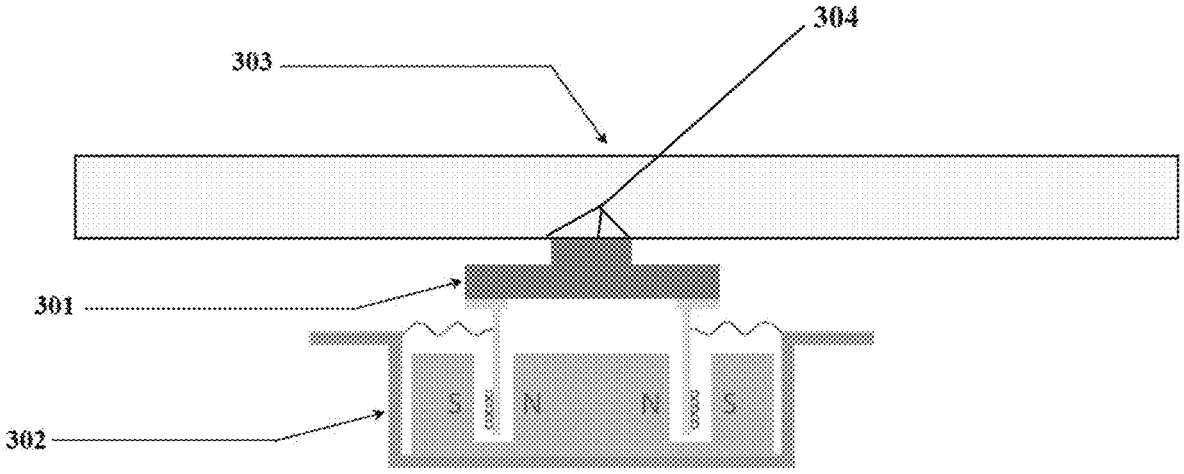
FIG. 3 shows a cross sectional drawing of an electrodynamic force actuator affixed to a loudspeaker panel with a force concentrator interposed between the force actuator and the panel.

FIG. 3 shows an embodiment in which a force concentrator (301) is interposed between the dynamic force actuator (302) and an elastic panel (303). One of ordinary skill will understand that the force concentrators described herein can be used with a wide variety of elastic panels of differing sizes and shapes and made of differing materials. The size, shape or material from which the elastic panel is made is not limiting upon the invention herein.

The contact area (304) between the dynamic force actuator and the panel is a small circular region. One of ordinary skill will understand that the size and shape of the contact area may vary and is not limiting on the invention disclosed herein.

The force concentrator may be bonded to the dynamic force actuator via an adhesive material or other kind of glue or epoxy and the other side of the force concentrator may be bonded to the panel using any of a variety of bonding agents including but not limited to cyanoacrylate glue, epoxies, and adhesives used for industrial tooling. One of ordinary skill will understand that the choice of adhesive is not limiting on the invention.

The surface area in contact with the panel does not necessarily have to be less than the surface area in contact with the voice coil, although it may be preferred in certain embodiments that the contact area with the panel is smaller than the contact area with the voice coil. In particular embodiments, the surface area in contact with the panel should be a continuous surface, not an annulus like the voice coil surface itself.

Figure 4A:
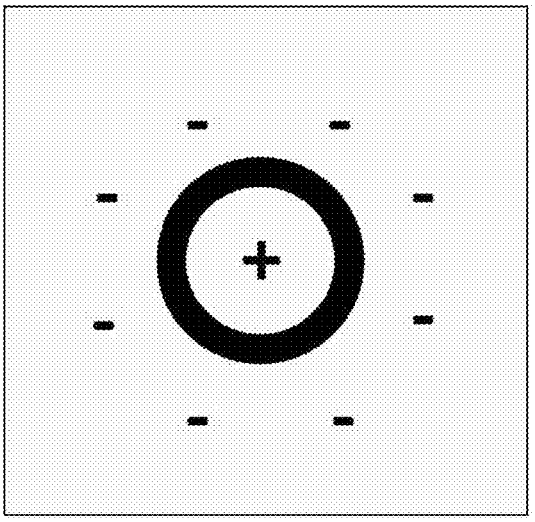
FIG. 4(*a*) shows a representation of panel vibrations phase at the frequency where a mechanical "drumhead" resonance of the region of the panel interior to the annular contact region of the force actuator appears (top view)
Figure 4B:
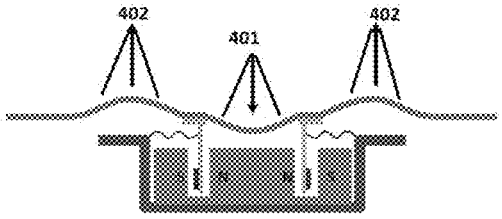
Figure 4C:
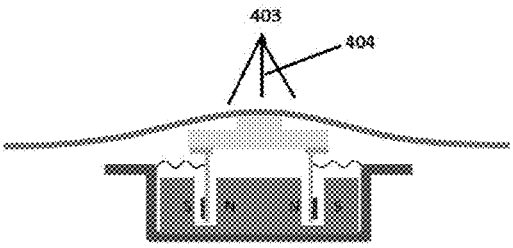

FIG. 4(*a*) shows a representation of the panel vibrations at the frequency where the mechanical "drumhead" resonance of the region of the panel interior to the annular contact region of the dynamic force actuator appears (top view). The region interior to the annular contact area vibrates out of phase ("+" sign within thick black circle) relative to the region of the panel exterior to the annular contact area ("−" signs outside the thick black circle).

FIG. 4(*b*) shows a side-view of the resonant condition in which the phase of the vibrations of the panel region interior (401) to the annular contact area is reversed in comparison to the phase of the vibrations exterior (402) to the annular contact area.

FIG. 4(*c*) shows a side view of the vibrations of the panel employing the force concentrator (403). There is no anti-phase vibrating region in this case so the integrated vibration profile of the panel does not exhibit a dip in its frequency response. As can be seen in this case, there is a single phase of vibrations interior (404) to the annular contact area.

One of ordinary skill will understand that the use of a force concentrator as described herein is not limited to use in generating sound while interposed between a voice coil actuator and an elastic panel.

Materials

The force concentrator should be comprised of a material of a suitable thickness and material properties so that the device does not introduce mechanical resonances of its own within the band of audible frequencies. One of ordinary skill will understand how to select materials with suitable properties to avoid such mechanical resonances.

In particular embodiments, the force concentrator may comprise aluminum alloy, titanium, beryllium or other metals with a high speed of sound transmission to ensure that all mechanical resonances of the device lie above the range of audible frequencies, wherein the mechanical resonances include longitudinal, bending and torsional waves.

In other specific embodiments, the force concentrator comprises composite materials including one or more selected from the group consisting of fiberglass, carbon fiber, and other composites with a high speed of sound transmission to insure that all mechanical resonances of the element lie above the range of audible frequencies.

In various embodiments, the force concentrator comprises synthetic materials including one or more selected from the group consisting of acrylic, polyvinylchloride, and other synthetic materials with a high speed of sound transmission to insure that all mechanical resonances of the element lie above the range of audible frequencies.

Shape

Figure 5A:
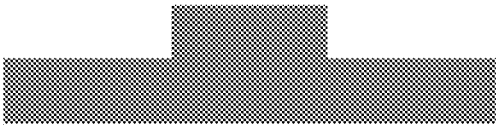
FIG. 5(*a*) shows a design of a force concentrator in which the transition is a step.
Figure 5C:
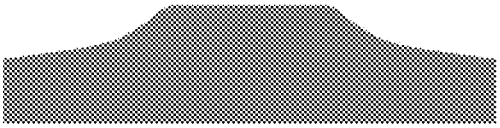
Figure 5B:
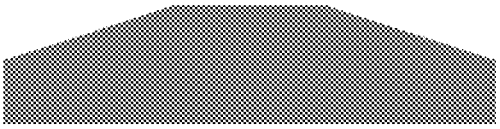

In certain embodiments, the base surface and plateau of the device form together a shape in which a surface having a greater surface area is coupled to the dynamic force actuator and a surface with a lesser surface area is coupled to the panel. FIG. 5(*a*) shows an embodiment of a force concentrator in which the transition from large to small diameter is a step; FIG. 5(*b*) shows an embodiment in which the transition from large to small is a linear ramp; and FIG. 5(*c*) shows an embodiment in which the transition is a tapered curve. One of ordinary skill will understand that the shape of the transition is not limiting on the invention herein.

In particular embodiments, the base surface is circular with a larger diameter than the concentrator surface. In specific embodiments, the transition is step-wise connecting the boundary to the concentrator surface by a step surface at 90 degrees to the boundary. In various embodiments, the transition is a concave surface connecting the boundary to the concentrator surface. In other embodiments, the transition is a tapered surface connecting the boundary to the concentrator surface. In another embodiment, the concentrator surface is circular. In another embodiment, the concentrator surface is square. In another embodiment, the concentrator surface is rectangular. In some embodiments, the base surface and plateau of the device form together a polygonal shape. In some embodiments, the base surface and plateau of the device form together an ellipsoidal shape. In some embodiments, the base surface area is the surface enclosed by any continuous closed curve and the plateau area is the surface enclosed by a second continuous closed curve. In various embodiments, the closed curves of the base and the plateau may be same shapes or they may be different.

Figure 6A:
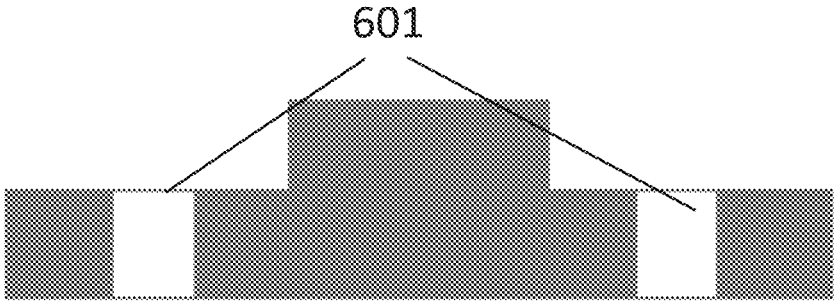
FIG. 6(*a*) shows a cross-sectional view of a force concentrator with vent holes.
Figure 6B:
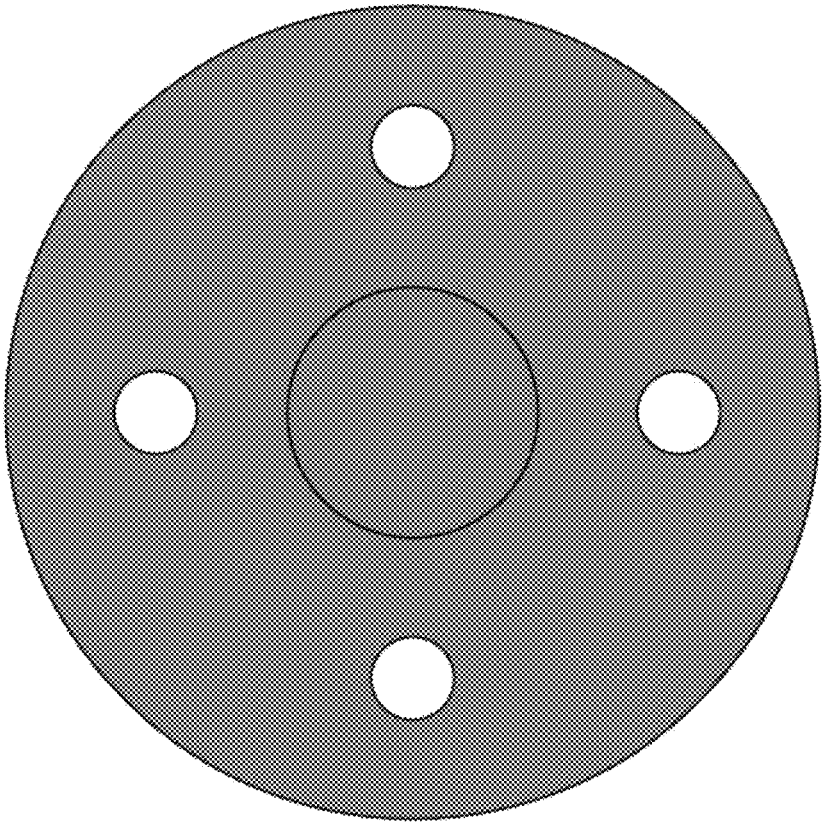

In particular embodiments, one or more vent holes are formed into the device to allow trapped air within the dynamic force actuator to escape. FIG. 6 shows two views of a force concentrator with vent holes (601). FIG. 6(*a*) is a cross-sectional view; and FIG. 6(*b*) is a top view. The vent holes prevent trapping of air within the dynamic force actuator in case the actuator is not vented itself. One of ordinary skill will understand that the placement or number of the vent holes is not limiting on the invention herein.

Methods of Use

In certain embodiments the device described herein may be used in connection to sound transmission from devices including, but not limited to, the following: mobile phones, electronic notepads, electronic tablets, electronic automobile dashboards (e.g., in ambulances or cars used for medical-related purposes), electronic motorcycle dashboards, electronic wristbands, electronic neckwear, wall-mounted screens, portable monitors (e.g. wheeled monitors in medical facilities), electronic headbands, electronic helmets, electronic eyewear (e.g. glasses with lens that can display information in real time to the wearer), electronic rings, networked computers (e.g. personal computers), remote viewing technology (e.g. rural doctor client-patient communication devices) and portable electronic devices in general. In certain embodiments, the device may be used in connection with a vibrational sensor, such as a piezoelectric or PVDF sensor, or accelerometer.

In certain embodiments, the force concentrators described herein may be used in a device as follows: a device for radiating sound, which comprises a panel, wherein the panel possesses one or more vibrational resonant modes; a plurality of dynamic force actuators, wherein the dynamic force actuators are positioned in an array at optimized locations on the panel to significantly actuate the lowest panel mode in a given frequency range, wherein the lowest panel mode is the lowest-frequency mode driven with significant force when the actuators are applying equal force to the panel; and a common signal source, wherein the source is connected to the plurality of dynamic force actuators, and wherein a signal is received by each of the plurality of force actuators from the common signal source, and further wherein the dynamic force produced by the plurality of force actuators upon the panel generates a radiation of sound from the panel in a selected frequency band, and further wherein a force concentrator is interposed between each of the plurality of force actuators and the panel. In particular embodiments, a modal crossover network connects the plurality of dynamic force actuators (having force concentrators) to a common signal source, and the common signal source is connected to the plurality of dynamic force actuators (having force concentrators) via the modal crossover network.

In certain embodiments, the force concentrators described herein may be used in a device as follows: a plate loudspeaker which comprises a modal crossover network, wherein the modal crossover network processes a signal into a plurality of sub-signals, each sub-signal associated with a frequency band; a spatial filter, wherein the spatial filter assigns each sub-signal to a plurality of drivers located on a plate and assigns a relative amplitude to each of the plurality of drivers, wherein the plate is driven to modes of motion by the plurality of drivers to generate the sound output of the plate loudspeaker, wherein each mode has a spatial shape function and a temporal function which modulates the spatial shape, wherein a force concentrator is interposed between each of the plurality of drivers and the panel, and wherein the sub-signal and the relative amplitude assigned to each of the plurality of drivers is determined based at least on a location of each of the plurality of drivers on the plate, and wherein each sub-signal is routed to its assigned one or more plurality of drivers through the modal crossover network and the plate loudspeaker is driven with the plurality of drivers having received the routed sub-signals at the assigned relative amplitude.

In certain embodiments, the force concentrators described herein may be used in a method as follows: a method for controlling the performance of a plate loudspeaker, the method comprising processing a signal into a plurality of sub-signals using a modal crossover network, wherein each sub-signal is associated with a frequency band; assigning each sub-signal to one or more of a plurality of drivers located on a plate and assigning a relative amplitude to each of the plurality of drivers, wherein the sub-signal and the relative amplitude assigned to each of the plurality of drivers is determined based at least on the location of the driver on the plate, wherein a force concentrator is interposed between each of the plurality of drivers and the panel, and wherein the plate is driven to modes of motion by the plurality of drivers to generate the sound output of the plate loudspeaker, wherein each mode has a spatial shape function and a temporal function which modulates the spatial shape; routing each sub-signal to its assigned one or more plurality of drivers; and driving the plate with the plurality of drivers having received the routed sub-signals at the assigned relative amplitude, wherein the modes of motion of the plate generate the sound output of the plate loudspeaker.

In certain embodiments, the force concentrators described herein may be used in a system as follows: a system which comprises plate loudspeaker; and a transmitter for transmitting a signal to the plate loudspeaker, wherein the plate loudspeaker comprises: a modal crossover network, wherein the modal crossover network is configured to process the signal into a plurality of sub-signals, each sub-signal associated with a frequency band; and a spatial filter, wherein the spatial filter is configured to assign each sub-signal to a plurality of drivers located on a plate and assigns a relative amplitude to each of the plurality of drivers, wherein the plate is driven to modes of motion by the plurality of drivers to generate the sound output of the plate loudspeaker, wherein each mode has a spatial shape function and a temporal function which modulates the spatial shape, wherein a force concentrator is interposed between each of the plurality of drivers and the panel, and wherein the sub-signal and the relative amplitude assigned to each of the plurality of drivers are determined based at least on a location of each of the plurality of drivers on the plate, wherein each sub-signal is routed to its assigned one or more plurality of drivers through the modal crossover network, and wherein the plate is driven with the plurality of drivers having received the routed sub-signals at the assigned relative amplitude.

In certain embodiments, the force concentrators described herein may be used in a device as follows: a loudspeaker which comprises a first elastic panel; a second elastic panel; a first layer of a first viscoelastic material affixed between the first elastic panel and the second rigid panel to form a combined panel; and at least one force actuator located at a surface of the first elastic panel; wherein, in response to an input signal, the at least one force actuator is driven to induce a bending motion in the combined panel to generate sound, and wherein a force concentrator is interposed between the at least one force actuator and the panel.

In certain embodiments, the force concentrators described herein may be used in a system as follows: a system for spatial and temporal control of the vibrations of a panel, comprising: a functional portion of a display; an audio layer comprising a plate and a plurality of driver elements, wherein a force concentrator is interposed between the plurality of driver elements and the plate, wherein the functional portion of the display is proximate to the audio layer, wherein the plurality of driver elements comprise a plurality of amplifiers; and a processor and a memory having instructions stored thereon, wherein execution of the instructions by the processor causes the processor to: receive a shape function and an audio signal; determine a band-limited Fourier series representation of the shape function; compute one or more modal accelerations from the audio signal and the band-limited Fourier series representation of the shape function; compute, using a frequency domain plate-bending mode response, one or more modal forces needed to produce the one or more modal accelerations; determine a response associated with a discrete-time filter corresponding to the frequency domain plate bending mode response; sum the one or more modal forces to determine a force required at each driver element in a plurality of driver elements; perform a multichannel digital-to-analog conversion and amplification of one or more forces required at each driver element in the plurality of driver elements; and drive the plurality of amplifiers with the converted and amplified forces required at each driver element in the plurality of driver elements.

Computer Systems

In certain embodiments the device herein may be used in connection with systems or devices controlled and networked via a computer system, the computer system includes a memory, a processor, and, optionally, a secondary storage device. In some embodiments, the computer system includes a plurality of processors and is configured as a plurality of, e.g., bladed servers, or other known server configurations. In particular embodiments, the computer system also includes an input device, a display device, and an output device.

In some embodiments, the memory includes RAM or similar types of memory. In particular embodiments, the memory stores one or more applications for execution by the processor. In some embodiments, the secondary storage device includes a hard disk drive, floppy disk drive, CD-ROM or DVD drive, or other types of non-volatile data storage.

In particular embodiments, the processor executes the application(s) that are stored in the memory or the secondary storage, or received from the internet or other network. In some embodiments, processing by the processor may be implemented in software, such as software modules, for execution by computers or other machines. These applications preferably include instructions executable to perform the functions and methods described herein. The applications preferably provide GUIs through which users may view and interact with the application(s). In other embodiments, the system comprises remote access to control and/or view the system.

The present application is further illustrated by the following examples that should not be construed as limiting.

EXAMPLES

Figure 7B:
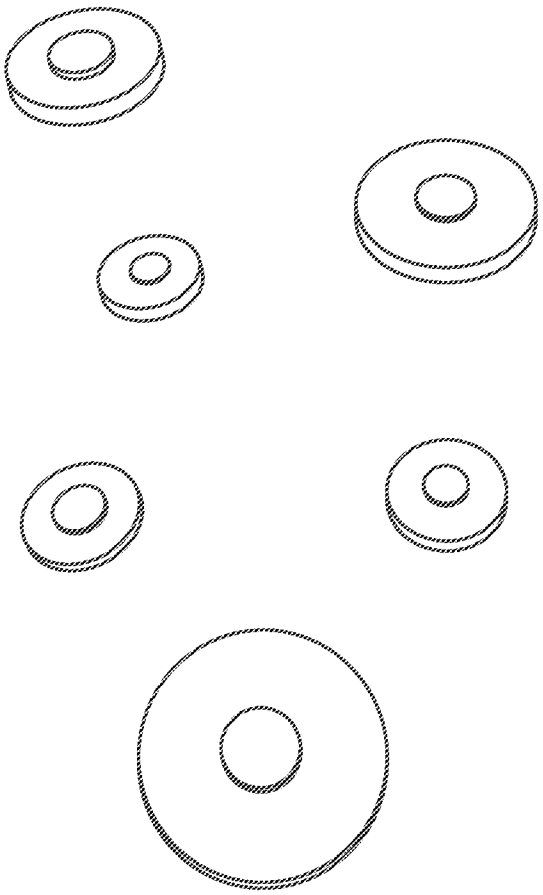
FIG. 7(*a*) shows a picture of a force concentrator mounted on a force actuator.
Figure 7A:
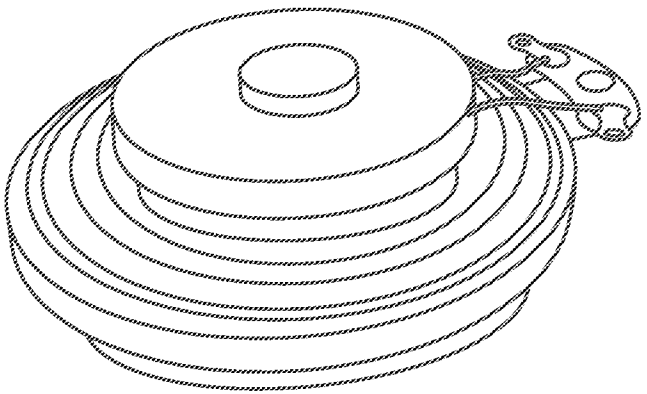

FIG. 7(*a*) shows a picture of a force concentrator mounted to a dynamic force actuator; FIG. 7(*b*) shows force concentrators in various sizes and thicknesses made of aluminum. One of ordinary skill will understand that the pictures show only certain embodiments and are not limiting on the invention.

Figure 8:
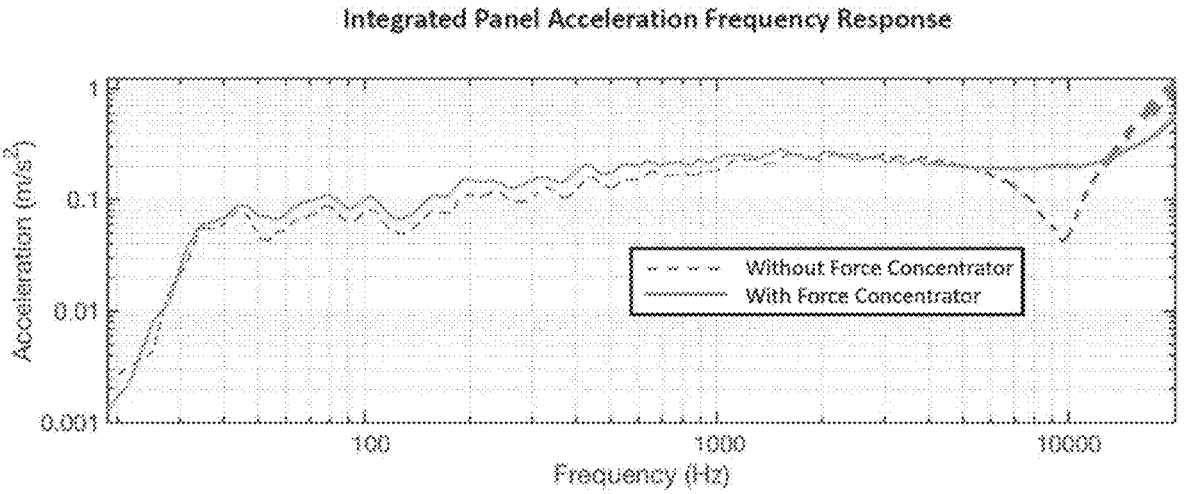
FIG. 8 shows the measured net acceleration of a panel integrated across the entire panel surface is plotted versus frequency.

FIG. 8 shows the measured net acceleration of an aluminum sandwich panel integrated across the entire panel surface plotted versus frequency. The total radiated sound pressure of the panel is in proportion to the panel acceleration. The acceleration curve labeled "without force concentrator" is for the case of a dynamic force actuator attached directly to the panel without a force concentrator; as can be seen the normal acceleration cure dips visibly at or near 10 kHz. The acceleration curve labeled "with force concentrator" is for the case of a dynamic force actuator attached to the panel with a force concentrator interposed between the dynamic force actuator and the panel. The observed dip in the integrated panel acceleration frequency response curve (without force concentrator curve) seen near 10 kHz translates to a dip in the radiated sound pressure at that frequency. When the force concentrator is employed as shown in FIG. 3 herein, the dip in the acceleration frequency response vanishes and the resulting sound radiation frequency response does not exhibit a dip at 10 kHz as it does without the force concentrator.

While various embodiments have been described above, it should be understood that such disclosures have been presented by way of example only and are not limiting. Thus, the breadth and scope of the subject compositions and methods should not be limited by any of the above-described exemplary embodiments, but should be defined only in accordance with the following claims and their equivalents. The contents of all references, including patent applications, such as U.S. application Ser. Nos. 15/255,366; 15/778,797; 15/753,679 and U.S. Prov. App. Nos. 62/745,307; 62/745,314, cited throughout this application, as well as the Figures and Tables, are incorporated herein by reference.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention, which is defined by the following claims. The claims are intended to cover the components and steps in any sequence which is effective to meet the objectives there intended, unless the context specifically indicates the contrary.

What is claimed is:

1. A mechanical coupling device for concentrating dynamic force transmitted from a dynamic force actuator to a panel, the device comprising:

a base surface, wherein the base surface is a surface that is coupled to an active surface of a dynamic force actuator;

a plateau on a reverse side of the device to the base surface, wherein the plateau has a top and sides, and wherein the top of the plateau is a concentrator surface that is coupled to a panel, and the sides of the plateau are a transition connecting the concentrator surface to an outer edge of the device on the reverse side of the device to the base surface; and wherein the concentrator surface is a continuous region with a surface area that may be smaller, larger, or the same surface area as a region of the base surface in contact with the dynamic force actuator, and wherein the concentrator surface transmits a dynamic force to a region of the panel coupled to the concentrator surface.

2. The mechanical coupling device of claim 1, wherein the device comprises aluminum alloy, titanium, beryllium or other metals with a high speed of sound to ensure that all mechanical resonances of the device lie above the range of audible frequencies, wherein the mechanical resonances include longitudinal, bending and torsional waves.

3. The mechanical coupling device of claim 1, wherein the device comprises composite materials including one or more selected from the group consisting of fiberglass, carbon fiber, and other composites with a high speed of sound to insure that all mechanical resonances of the element lie above the range of audible frequencies.

4. The mechanical coupling device of claim 1, wherein the device comprises synthetic materials including one or more selected from the group consisting of acrylic, polyvinylchloride, and other synthetic materials with a high speed of sound to ensure that all mechanical resonances of the element lie above the range of audible frequencies.

5. The mechanical coupling device of claim 1, wherein one or more vent holes are formed into the device to allow trapped air within the dynamic force actuator to escape.

6. The mechanical coupling device of claim 1, wherein the base surface is circular with a larger diameter than the concentrator surface.

7. The mechanical coupling device of claim 1, wherein the transition is step-wise connecting the boundary to the concentrator surface by a step surface at 90 degrees to the boundary.

8. The mechanical coupling device of claim 1, wherein the transition is a concave surface connecting the boundary to the concentrator surface.

9. The mechanical coupling device of claim 1, wherein the transition is a tapered surface connecting the boundary to the concentrator surface.

10. The mechanical coupling device of claim 1, wherein the concentrator surface is circular.

11. The mechanical coupling device of claim 1, wherein the concentrator surface is square.

12. The mechanical coupling device of claim 1, wherein the concentrator surface is rectangular.

13. The mechanical coupling device of claim 1, wherein the base surface and plateau of the device form together a polygonal shape.

14. The mechanical coupling device of claim 1, wherein the base surface and plateau of the device form together an ellipsoidal shape.

15. The mechanical coupling device of claim 1, wherein the base surface and plateau of the device form together a shape in which a surface having a greater surface area is coupled to the dynamic force actuator and a surface with a lesser surface area is coupled to the panel.

16. A method of generating sound using the mechanical device of claim 1, comprising the steps of:

interposing the device of claim 1 between an active surface of a dynamic force actuator and a panel;

generating a dynamic force with the dynamic force actuator;

transmitting the dynamic force through the device of claim 1 via the concentrator surface to the panel;

generating sound from the panel through the action of the dynamic force transmitted by the device of claim 1.

17. The method of claim 16, wherein the panel is a component of a flat panel loudspeaker.

18. The method of claim 16, wherein the dynamic force actuator is a voice coil.

19. A method of concentrating a dynamic force generated by a dynamic force actuator onto a flat panel, comprising the steps of:

adhering the base surface of the device of claim 1 to an active surface of a dynamic force actuator;

adhering the concentrator surface of the device of claim 1 to a panel;

generating a dynamic force with the dynamic force actuator;

transmitting the dynamic force through the device of claim 1 via the concentrator surface to the panel.

20. The method of claim 19, wherein the adhering is performed by use of a glue.

* * * * *